US012292227B2

(12) United States Patent
Li et al.

(10) Patent No.: US 12,292,227 B2
(45) Date of Patent: May 6, 2025

(54) REFRIGERATOR DOOR WITH REPLACEABLE DOOR PANEL

(71) Applicants: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

(72) Inventors: Xiaofeng Li, Qingdao (CN); Wenchun Wang, Qingdao (CN); Hao Zhang, Qingdao (CN); Xuan Ji, Qingdao (CN); Enpin Xia, Qingdao (CN)

(73) Assignees: CHONGQING HAIER REFRIGERATOR ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 129 days.

(21) Appl. No.: 18/013,208

(22) PCT Filed: Jun. 18, 2021

(86) PCT No.: PCT/CN2021/100878
§ 371 (c)(1),
(2) Date: Dec. 27, 2022

(87) PCT Pub. No.: WO2022/001696
PCT Pub. Date: Jan. 6, 2022

(65) Prior Publication Data

US 2023/0251023 A1 Aug. 10, 2023

(30) Foreign Application Priority Data

Jun. 30, 2020 (CN) ..... 202010623440.8

(51) Int. Cl.
*F25D 23/02* (2006.01)

(52) U.S. Cl.
CPC ..... *F25D 23/028* (2013.01); *F25D 2323/02* (2013.01); *F25D 2400/18* (2013.01)

(58) Field of Classification Search
CPC ..... F25D 23/028; F25D 2323/02; F25D 2400/18; F25D 2201/12; F25D 23/02; E05C 19/161
See application file for complete search history.

(56) References Cited

U.S. PATENT DOCUMENTS 4,383,519 A * 5/1983 Katona ..... F24C 15/024 126/190
6,840,773 B2 * 1/2005 Anderson ..... B44C 1/10 434/81

(Continued)

FOREIGN PATENT DOCUMENTS

CN 2499768 Y 7/2002
CN 102384627 A * 3/2012

(Continued)

*Primary Examiner* — Hanh V Tran
(74) *Attorney, Agent, or Firm* — Cheng-Ju Chiang

(57) ABSTRACT

The present invention provides a refrigerator door with a replaceable door panel, comprising: a foam door body, and a front panel detachably connected to the foam door body; a first limiting member and a second limiting member are disposed on a front side of the foam door body; a frame is sandwiched between the front panel and the foam door body, the frame is attached to a rear side of the front panel, a hook is disposed on the frame, and the hook has an insertion plate portion; wherein when the front panel is assembled on the front side of the foam door body, the first limiting member, in cooperation with the insertion plate portion, limits a displacement of the front panel in a first direction; the second limiting member, in cooperation of the frame, limits a displacement of the front panel in a second direction.

10 Claims, 10 Drawing Sheets

(56) References Cited

U.S. PATENT DOCUMENTS

| | | | | |
|---|---|---|---|---|
| 7,770,985 | B2 * | 8/2010 | Davis | E06B 3/7001 312/328 |
| 9,339,993 | B2 * | 5/2016 | Cites | B32B 3/04 |
| 10,317,128 | B2 * | 6/2019 | Son | E05D 11/1014 |
| 11,320,192 | B2 * | 5/2022 | Lee | E06B 3/4627 |
| 11,402,147 | B2 * | 8/2022 | Lee | F25D 23/02 |
| 11,480,384 | B2 * | 10/2022 | Lee | F25C 5/22 |
| 11,867,450 | B2 * | 1/2024 | Lee | F25D 23/02 |
| 2004/0245900 | A1 | 12/2004 | Parkkinen | |
| 2011/0025173 | A1 * | 2/2011 | Ciyanoglu | F25D 23/10 312/204 |
| 2012/0073202 | A1 * | 3/2012 | Lee | F25D 29/005 49/70 |
| 2012/0169196 | A1 * | 7/2012 | Marchetti | E06B 5/006 312/265.6 |
| 2018/0172337 | A1 * | 6/2018 | Choi | A47F 3/043 |
| 2019/0053685 | A1 * | 2/2019 | Chwalibog | A47L 15/4293 |
| 2023/0251020 | A1 * | 8/2023 | Li | F25D 23/028 49/501 |
| 2023/0251022 | A1 * | 8/2023 | Li | F25D 23/028 49/501 |

FOREIGN PATENT DOCUMENTS

| | | | | |
|---|---|---|---|---|
| CN | 204478663 | U | 7/2015 | |
| CN | 104913585 | A | 9/2015 | |
| CN | 105333668 | A | 2/2016 | |
| CN | 107700988 | A | 2/2018 | |
| CN | 107702418 | A | 2/2018 | |
| CN | 207299701 | U | 5/2018 | |
| CN | 208765356 | U | 4/2019 | |
| CN | 210119057 | U | 2/2020 | |
| CN | 210220367 | U | 3/2020 | |
| EP | 599160 | A1 * | 6/1994 | A47B 95/02 |
| EP | 0647821 | A1 * | 4/1995 | |
| EP | 1650512 | A2 | 4/2006 | |
| EP | 2843329 | A2 * | 3/2015 | F25D 23/028 |
| EP | 3690369 | A1 * | 8/2020 | |
| JP | 2008-57899 | A | 3/2008 | |
| JP | 2016156556 | A * | 9/2016 | |
| KR | 10-2006-0068754 | A | 6/2006 | |
| WO | WO-2014024429 | A1 * | 2/2014 | F25D 23/02 |
| WO | 2015/033754 | A1 | 3/2015 | |
| WO | WO-2016009398 | A1 * | 1/2016 | F25D 23/028 |

* cited by examiner

REFRIGERATOR DOOR WITH REPLACEABLE DOOR PANEL

CROSS REFERENCE TO RELATED APPLICATIONS

The present application is a 35 U.S.C. § 371 National Phase conversion of International (PCT) Patent Application No. PCT/CN2021/100878, filed on Jun. 18, 2021, which claims the priority of Chinese Application No. 202010623440.8 filed on Jun. 30, 2020, the disclosure of which is incorporated by reference herein. The PCT International Patent Application was filed and published in Chinese.

TECHNICAL FIELD

The present invention relates to the technical field of household appliances, and particularly to a refrigerator door with a replaceable door panel.

BACKGROUND

Along with constant development of science and technology, a refrigerator has already become one of indispensable household appliances. In current application, as the user's demands increase, the refrigerator is also required to exist as a decoration in the household environment in addition to as a household appliance; before buying the refrigerator, the user usually has many requirements for the refrigerator such as color and pattern, and a single appearance of the refrigerator affects the user's buying demands. In addition, since a service life of the refrigerator can usually be in a range of 8 years to 10 years, during use of the refrigerator by the user, the appearance of the refrigerator once bought cannot satisfy the user's demands for long-term adjustment as the environment and scenario change; in another case, the door panel also has a risk of being broken during use and transportation of the refrigerator; in the above cases, if the whole door body of the refrigerator is replaced, the replacement cost is high and the use of the refrigerator is also affected, which is not conducive in satisfying the consumer's demands.

SUMMARY

An object of the present invention is to provide a refrigerator door with a replaceable door panel, which is capable of overcoming the impact exerted by an external force on a front panel during the transportation of the refrigerator.

In order to achieve one of the above object, an embodiment of the present invention provides a refrigerator door with a replaceable door panel, wherein the refrigerator door comprises:

- a foam door body, and a front panel detachably connected to the foam door body;
- a first limiting member and a second limiting member are disposed on a front side of the foam door body;
- a frame is sandwiched between the front panel and the foam door body, the frame is attached to a rear side of the front panel, a hook is disposed on the frame, and the hook has an insertion plate portion;
- wherein when the front panel is assembled on the front side of the foam door body, the first limiting member, in cooperation with the insertion plate portion, limits a displacement of the front panel in a first direction; the second limiting member, in cooperation of the frame, limits a displacement of the front panel in a second direction.

As an optional embodiment, wherein the first limiting member is a stopper which is disposed in a stopping groove of the foam door body, the insertion plate portion is inserted in the stopping groove, and the stopper elastically pushes and resists against the insertion plate portion in an up-down direction; the second limiting member is a magnetic member, and the magnetic member and the frame magnetically attract each other in a front-rear direction perpendicular to the front panel.

As an optional embodiment, wherein the magnetic member is a magnet, the frame is a metal frame, and the metal frame and the magnetic member magnetically attract each other in the front-rear direction perpendicular to the front panel.

As an optional embodiment, wherein the stopper comprises a body portion and an elastic portion, the elastic portion is disposed below the body portion, the elastic portion extends from an opening of the stopping groove towards rearward the stopping groove, and the elastic portion elastically pushes and resists against the insertion plate portion in the first direction.

As an optional embodiment, wherein a front end of the elastic portion is connected to a front end of the body portion, and a rear end of the elastic portion is suspended below the body portion and spaced apart a gap from the body portion.

As an optional embodiment, wherein the elastic portion extends obliquely downward along the front end of the body portion toward the rear end of the body portion.

As an optional embodiment, wherein a positioning block is disposed in the hook groove, the hook comprises a bent portion, a positioning notch is disposed on the bent portion, wherein when the front panel is assembled on the front side of the foam door body, the bent portion is inserted in the hook groove, and the positioning notch and the positioning block snap-fit each other.

As an optional embodiment, wherein the hook further comprises a connecting portion, both ends of the connecting portion are respectively connected with the bent portion and the frame, and the insertion plate portion is located on a lateral side of the connecting portion and protrudes in a direction away from the lateral side.

As an optional embodiment, wherein the refrigerator door further comprises a handle portion comprising a front handle and a rear handle, the front handle and the rear handle are respectively assembled in the stopping groove of the foam door body, and wherein a snap-fitting groove on the front handle and a boss of the rear handle snap-fit each other.

As an optional embodiment, wherein the boss comprises a cavity, and a top end of the boss is provided with a through hole; a cap body is disposed on a side of the snap-fitting groove away from the boss, and the cap body has another cavity, the through hole communicates the cavity of the boss with the another cavity of the cap body, wherein a bolt passes through the cavity and the through hole of the boss in turn and enter the another cavity of the cap body, thereby locking the boss and the cap body to each other.

As compared with the prior art, the present invention provides a refrigerator door with a replaceable door panel, wherein the hook on the rear side of the front panel and the first limiting member on the foam door body engage each other to limit the front panel in the first direction, and the frame on the rear side of the front panel and the second limiting member of the foam door body engage each other to limit the front panel in the second direction, thereby achieving the limitation of the front panel in a plurality of different directions, and thereby significantly improving the strength of the refrigerator door with the replaceable door panel, and adapting to the influence exerted by the transportation and the drop condition on the refrigerator door with the replaceable door panel.

DETAILED DESCRIPTION

Figure 1:
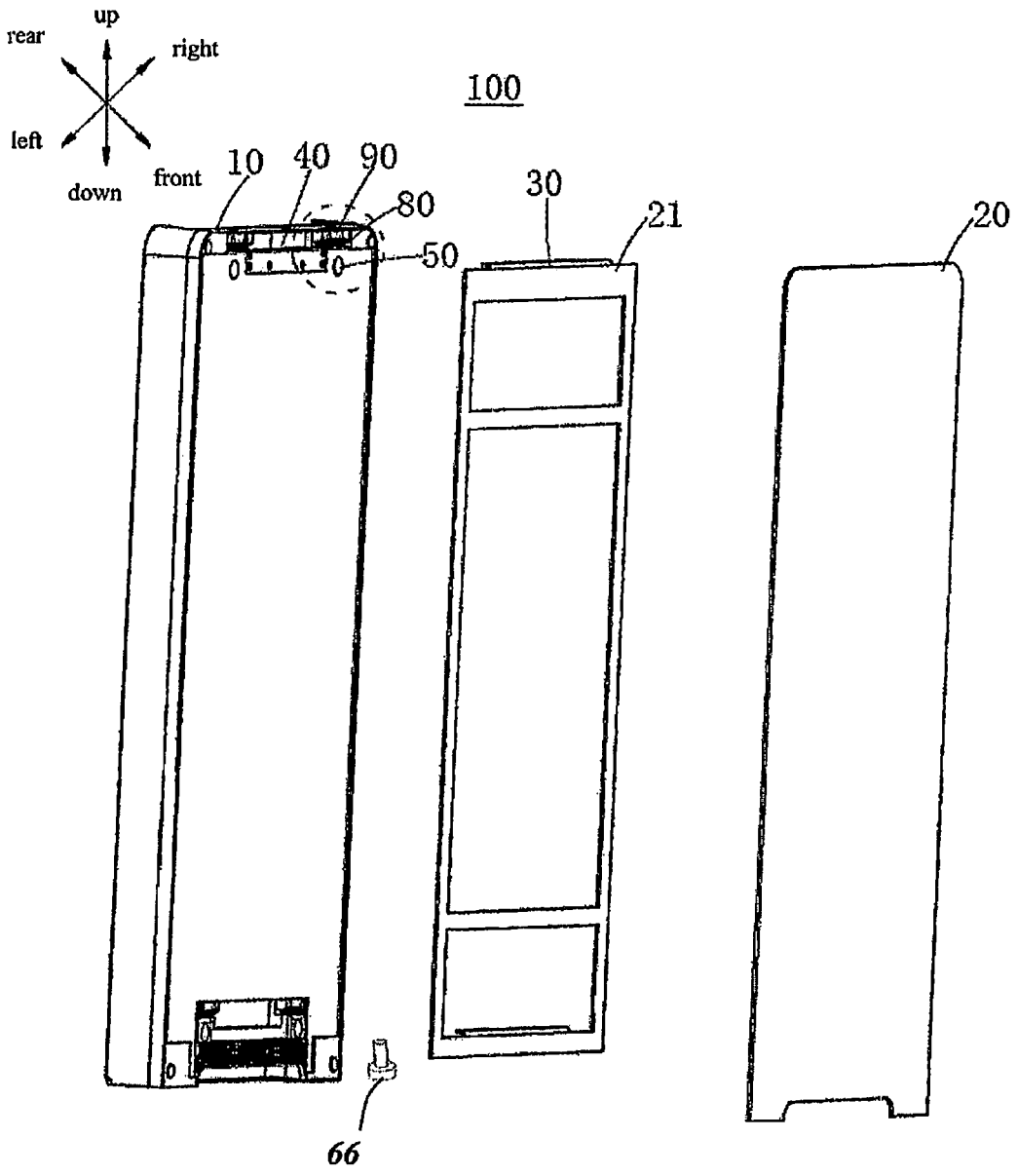
FIG. 1 is an exploded view of a refrigerator door with a replaceable door panel according to an embodiment of the present invention as viewed from a first angle of view.

The present invention will be described in detail below in combination with embodiments shown in the figures. However, these embodiments do not limit the present invention, and structural or functional changes made by those having ordinary skill in the art according to these embodiments are all included in the protection scope of the present invention.

As shown in FIG. 1 through FIG. 5C, the present invention provides a refrigerator door 100 with a replaceable door panel, comprising: a foam door body 10, and a front panel 20 detachably connected to the foam door body 10, wherein a first limiting member and a second limiting member are disposed on a front side of the foam door body 10; a frame 21 is disposed on a rear side of the front panel 20, the frame 21 is attached to a rear side of the front panel 20, a hook 30 is disposed on the frame 21, and the hook 30 has an insertion plate portion 33; when the front panel 20 is assembled on the front side of the foam door body 10, the first limiting member, in cooperation with the insertion plate portion 33, limits a displacement of the front panel in a first direction; the second limiting member, in cooperation of the frame 21, limits a displacement of the front panel 20 in a second direction.

In the present embodiment, the first direction and the second direction are perpendicular to each other. Specifically, the first limiting member is a stopper 90 which is disposed in a stopping groove 80 on a front side of the foam door body 10, wherein the insertion plate portion 33 of the hook 30 is horizontally inserted into the stopping groove 80, and is elastically resisted by the stopper 90 in an up-down direction; the second limiting member is a magnetic member 50 which is embedded in the foam door body 10. The magnetic member 50 and the frame 21 magnetically attract each other in a front-rear direction perpendicular to the front panel 20.

The insertion plate portion 33 of the hook 30 is limited by the stopper 90 in the up-down direction, so that the displacement of the front panel 20 in the up-down direction is limited; the magnetic member 50 and the frame 21 magnetically attract each other in the front-rear direction perpendicular to the front panel 20, so that the displacement of the front panel 20 in the front-rear direction is limited. Therefore, after the front panel 20 is assembled to the front side of the foam door body 10, the front panel 20 will not move in the up-down direction and the front-rear direction.

The "front-rear direction" refers to a direction perpendicular to the front panel 20; the "up-down" direction refers to a direction consistent with a length direction of the front panel 20.

In a preferred embodiment, the magnetic member 50 is for example a magnet, and the frame 21 is for example a metal frame, which magnetically attracts with the magnet.

Figure 2:
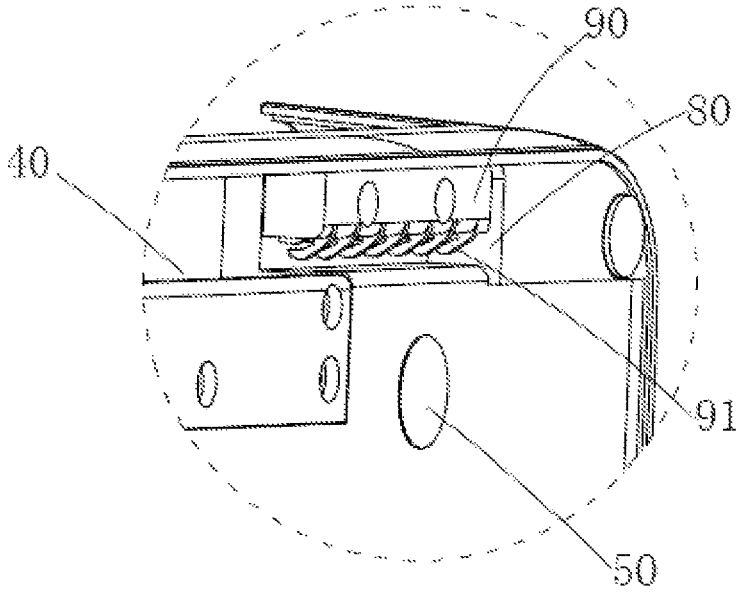
FIG. 2 is an enlarged view of a dashed region in FIG. 1.

As shown in FIG. 2, the stopper 90 comprises an elastic portion 91 and a body portion 92. An upper side of the body portion 92 engages a top wall of the stopping groove 80, the elastic portion 91 is disposed below the body portion 92, the elastic portion 91 extends from an opening on a front side of the stopping groove 80 towards rearward the stopping groove 80, and the elastic portion 91 elastically pushes and resists against the insertion plate portion 33 downward in the up-down direction (as shown in FIG. 5C).

In other embodiments of the invention, a lower side of the stopper engages a bottom wall of the stopping groove, the elastic portion is disposed on an upper side of the body portion, the elastic portion extends from the opening on the front side of the stopping groove towards rearward the stopping groove, and the elastic portion elastically pushes and resists against the insertion plate portion upwards in the up-down direction.

That is to say, the displacement of the front panel in the up-down direction may be achieved in a way that the elastic portion of the stopper pushes and resists against the insertion plate portion of the hook upwards or downwards in the up-down direction.

The stopper 90 may be formed in the stopping groove 80 by being integrally formed with the foam door body 10, and may also be fixed in the stopping groove 80 by being fastened with a screw.

As shown in FIG. 2 and FIG. 5A through FIG. 5C, a front end of the elastic portion 91 of the stopper 90 is connected to a front end of the body portion 92, and a rear end of the elastic portion 91 is suspended on a side of the body portion 92 and spaced apart a gap 93 from the body portion 92. In the present embodiment, the elastic portion 91 extends obliquely downward along the front end of the body portion 92 toward the rear end of the body portion 92. But the extension manner of the elastic portion 91 is not limited to this here. In other embodiments of the present invention, when the elastic portion is disposed on the upper side of the body portion, the elastic portion may extend obliquely upward from the front end of the body portion toward the rear end of the body portion.

The gap 93 may provide a deformation space for the elastic portion 91. For example, when the refrigerator door 100 with a replaceable door panel is impacted by an external force, the elastic portion 91 is deformed to overcome the impact of the external force on the door body, thereby achieving the buffering and shock-absorbing effect without affecting the elastic portion 91 in elastically pushing and resisting against the insertion plate portion 33; alternatively, when the front panel is detached from the foam door body 10, the insertion plate portion 30 squeezes the elastic portion 91. After the elastic portion 91 is deformed, it makes partial space so that the insertion plate portion 30 can be more easily disengaged from the stopping groove 80, thereby making the detachment of the front panel 20 easier.

Figure 3:
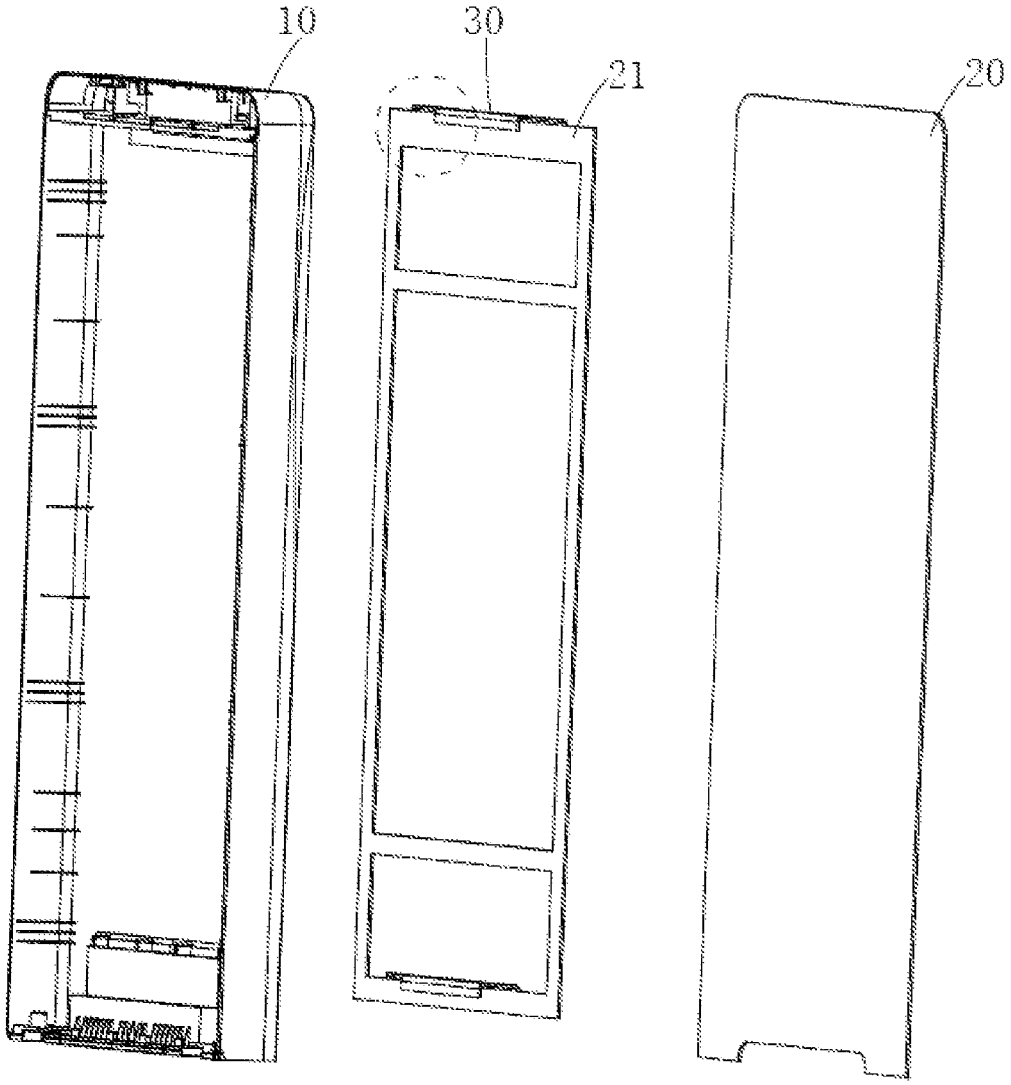
FIG. 3 is an exploded view of the refrigerator door with a replaceable door panel in FIG. 1 as viewed from a second angle of view.
Figure 4:
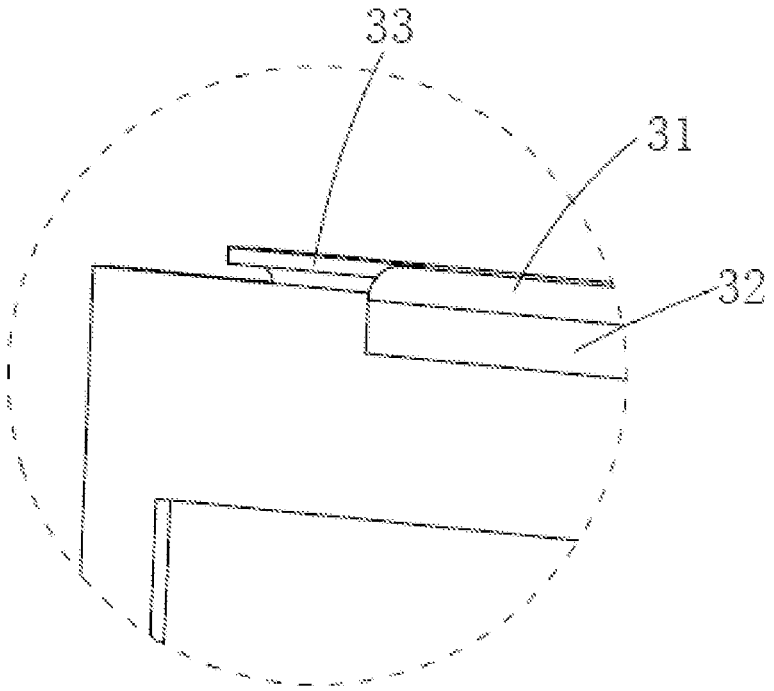
FIG. 4 is an enlarged view of a dashed region in FIG. 3.

As shown in FIG. 3 and FIG. 4, the hook 30 and the frame 21 are an integrally-formed sheet metal member which protrudes from the frame 21 towards the foam door body 10; the hook 30 comprises a connecting portion 31, a bent portion 32 and the insertion plate portion 33; opposite ends of the connecting portion 31 are respectively connected with the bent portion 32 and the frame 21; the insertion plate portion 33 protrudes from a lateral side of the connecting portion 31.

In the present embodiment, a pair of insertion plate portions 33 protrude from two opposite lateral sides of the connecting portion 31, and a side of the insertion plate portion 33 is connected to the frame 21. The pair of insertion plate portions 33 are respectively inserted into a pair of stopping grooves 80 on the front side of the foam door body 10.

Corresponding to the connecting portion 31 and the bent portion 32 of the hook 30, a hook groove 40 is disposed on the front side of the foam door body 10, and the stopping groove 80 is disposed on left and right groove walls of the hook 40, wherein the stopping grooves 80 and the hook groove 40 are communicated with each other. When the front panel 20 is assembled on the front side of the foam door body 10, the bent portion 32 and the connecting portion 31 of the hook 30 enter the hook groove 40.

A front side of the hook groove 40 is an open structure which comprises a step portion, a shielding block 401 is disposed on the step portion, a notch is formed between the shielding block 401 and the open structure, and the bent portion 32 and connecting portion 31 of the hook 30 enter through the notch into the hook groove 40.

Figure 8:
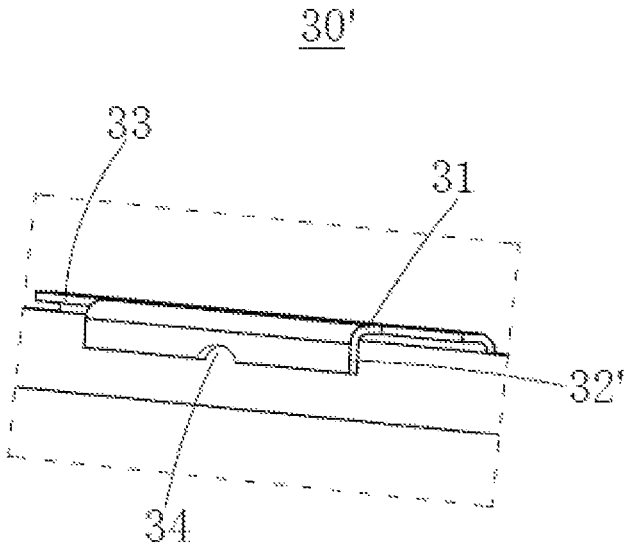
FIG. 8 is an exploded view of a hook in another embodiment of the present invention.
Figure 9:
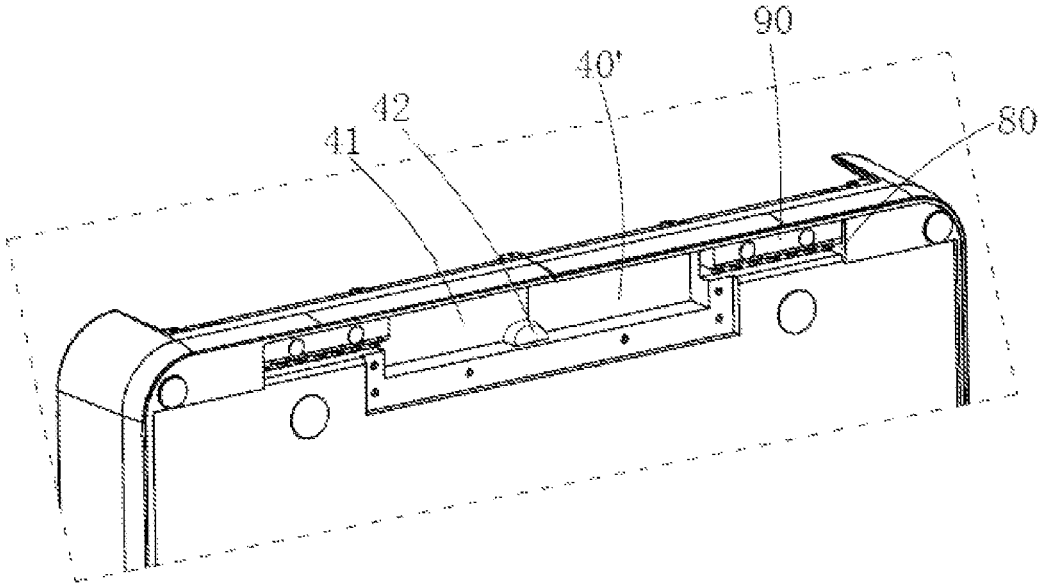
FIG. 9 is an exploded view of a side of the foam door body in a further embodiment of the present invention.

As shown in FIG. 8 and FIG. 9, in another embodiment of the present invention, the bent portion 33' of the hook 30' further comprises a positioning notch 34; corresponding to the positioning notch 34, a positioning block 42 is disposed on the rear groove wall 41 of the hook groove 40'; when the front panel 20 is assembled on the front side of the foam door body 10, the positioning notch 34 and the positioning block 42 snap-fit each other to limit the hook 30' from a displacement of the hook groove 40' in a left-right direction and thereby limit the displacement of the front panel 20 relative to the foam door body 10 in the left-right direction, so that the front panel 20 is engaged on the foam door body more stably. The "left-right direction" refers to a direction consistent with a width direction of the front panel 20.

Figure 6:
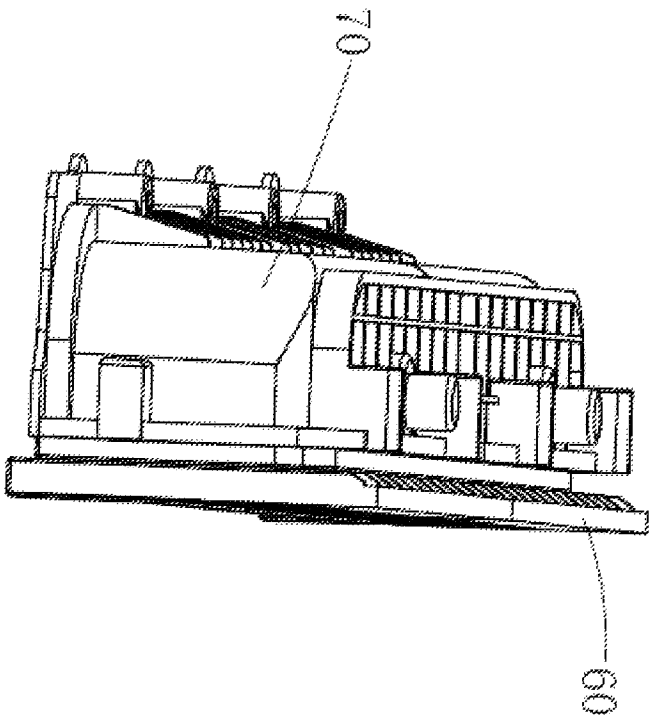
FIG. 6 is a view after the assembling of a front handle and a rear handle in a foam door body in the present invention.
Figure 7:
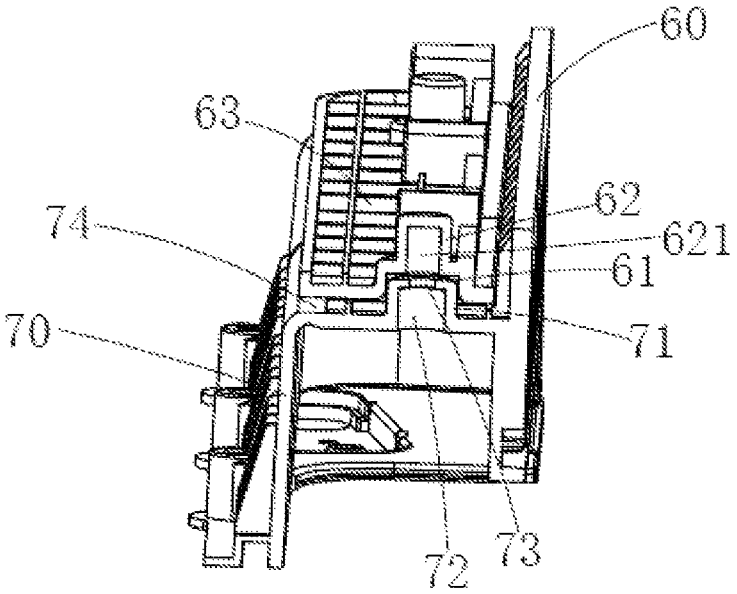
FIG. 7 is a cross-sectional view of after the front handle and the rear handle are assembled in FIG. 6.

As shown in FIG. 1, FIG. 6 and FIG. 7, the refrigerator door further comprises a handle portion comprising a front handle 60 and a rear handle 70, wherein the front handle 60 and the rear handle 70, after being assembled together, are mounted in the stopping groove 80 in the foam door body 10.

A snap-fitting groove 61 on the front handle 60 and a boss 71 of the rear handle 70 snap-fit each other. The boss 71 comprises a cavity 72, and a top end of the boss 71 is provided with a through hole 73; a cap body 62 is disposed on a side of the snap-fitting groove 61 away from the boss 71, and the cap body 62 has a cavity 621; the through hole 73 communicates the cavity 72 with the cavity 621. A bolt 66 passes through the cavity 72 and the through hole 73 in turn and enter the cavity 621, locking the boss 71 and the cap body 62 to each other, so that the front handle 60 and the rear handle 70 are locked in an up-down direction. The "up-down" direction is parallel to a height direction of the refrigerator door 100 with the replaceable door panel. The snap-fitting groove 61 snap-fits with the boss 71 to limit a displacement of the front handle 60 and the rear handle 70 in a horizontal direction, and the bolt 66 passes through the cavity 72 and the through hole 73 of the boss 71 to lock with the cap body 62 of the snap-fitting groove 61 to limit the displacement of the front handle 60 and the rear handle 70 in the up-down direction.

The boss 71 is formed on a first plate 74 of the rear handle 70, and the snap-fitting groove 61 is formed on a second plate 63 of the front handle 60. The first plate 74 and the second plate 63 extend opposite to each other. After the front handle 60 and the rear handle 70 are assembled, the first plate 74 is superimposed under the second plate 63.

Figure 5A:
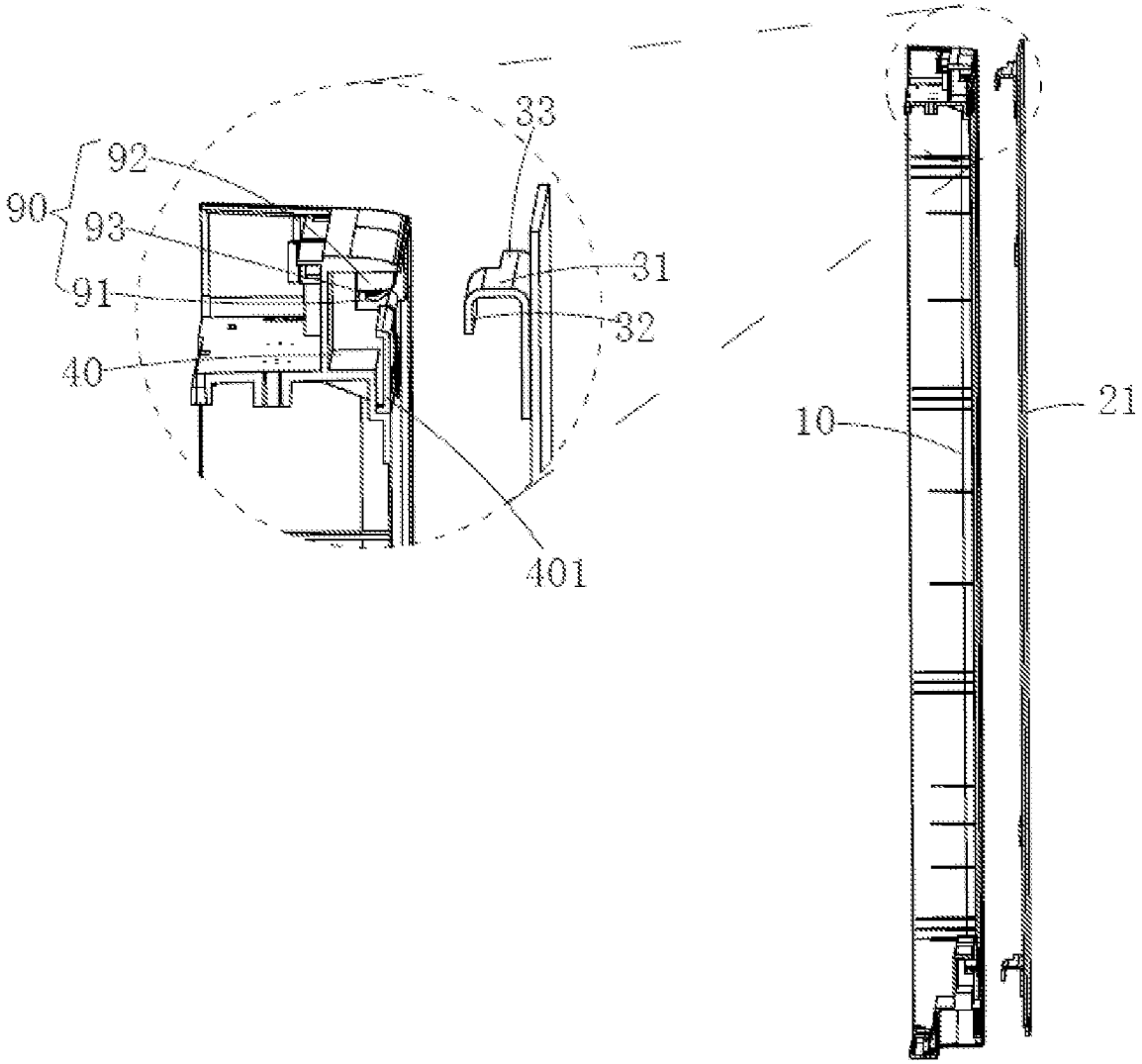
FIG. 5A through FIG. 5C are cross-sectional views of the refrigerator door with a replaceable door panel in FIG. 1 during the assembling.
Figure 5B:
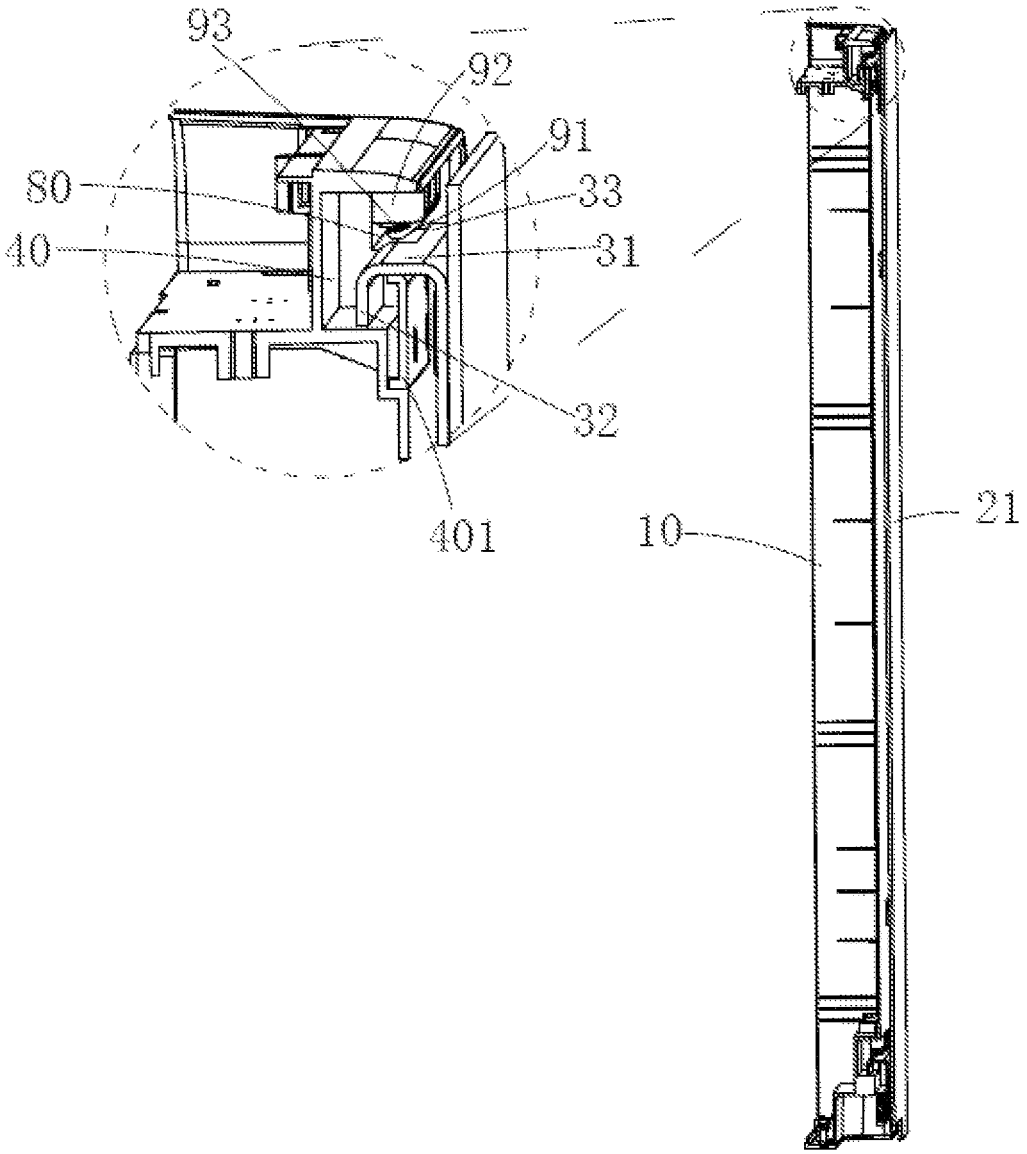
Figure 5C:
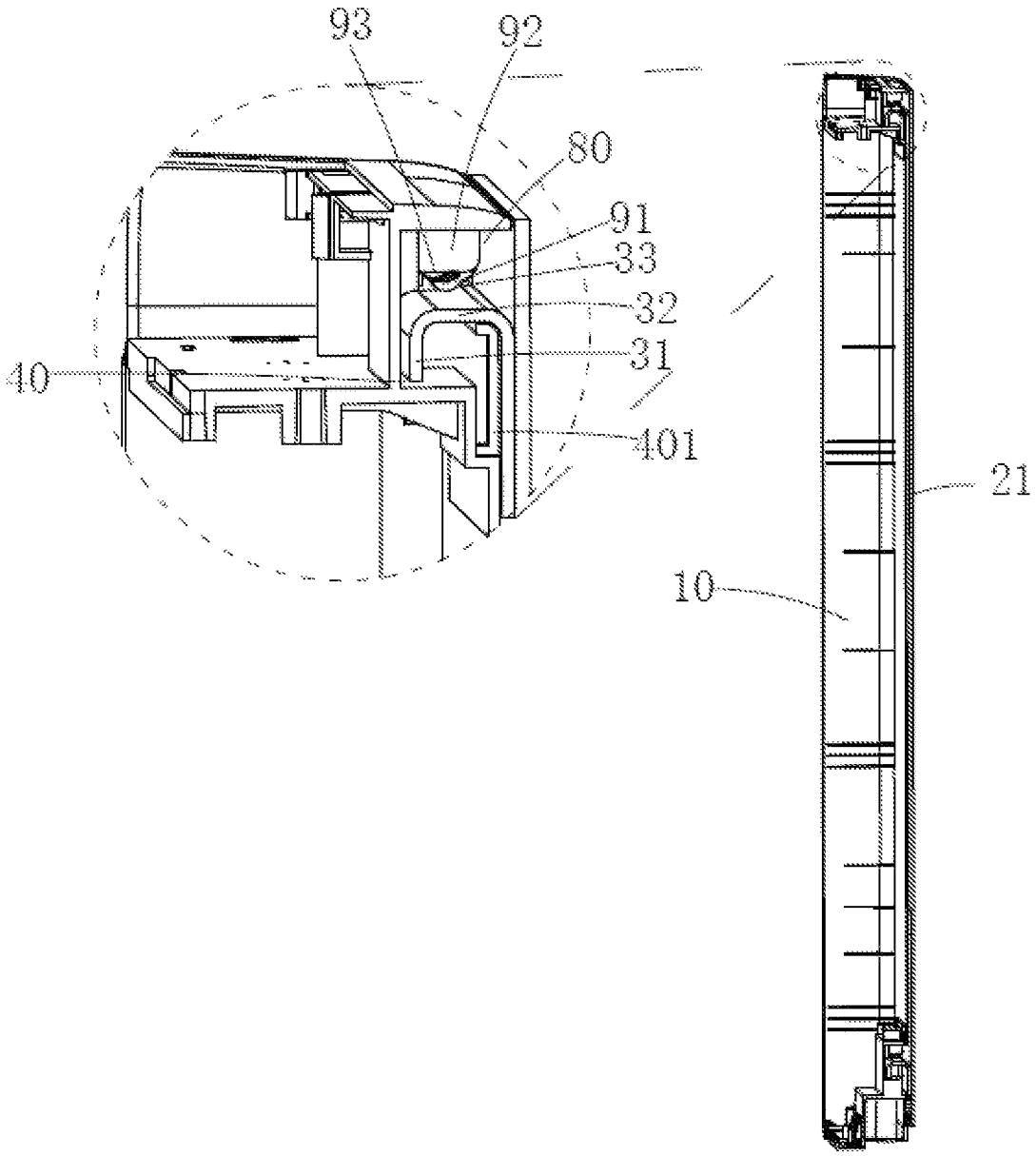

As shown in FIG. 5A through FIG. 5C, the assembling process of front panel 20 and foam door body 10 is roughly as follows:

First, the hook 30 on the frame 21 at the rear side of the front panel 20 is inserted into the hook groove 40, the bent portion 32 falls to the bottom of the hook groove 40, the insertion plate portion 33 of the hook 30 is flush with the lower portion of the stopping groove 80; then, the front panel 20 is pushed close to the foam door body 10, the insertion plate portion 33 is horizontally inserted into the stopping groove 80 and is elastically and downwardly pushed and resisted by the elastic portion 91 of the stopper 90; then, the frame 21 and the magnetic member 50 on the foam door body 10 magnetically attract each other in the front-rear direction, and the front panel 20 is closely attached to the front side of the foam door body 10.

The insertion plate portion 33 of the hook 30 and the stopper 90 may limit the front panel 20 in the up-down direction, and the magnetic member 50 and the frame 21 may limit the front panel 20 in the front-rear direction. Since the limitation of the front panel 20 in a plurality of directions significantly improves the strength of the refrigerator door 100 with a replaceable door panel, the influence exerted by the transportation and the drop condition on the refrigerator door may be effectively avoided even in the transportation process of the refrigerator door.

In addition, the upper end and lower end of the frame 21 are respectively provided with the hook 30 having the insertion plate portion 33, and the upper end and lower end of the foam door body 10 are respectively provided with the stopping groove 80 and the stopper 90. The magnetic members 50 are disposed at four corners of the foam door body 10. In addition, the magnetic element 50 may be additionally provided below the stopping groove 80 to improve the magnetic stability.

To conclude, the present invention provides a refrigerator door with a replaceable door, wherein the hook on the rear side of the front panel and the first limiting member on the foam door body engage each other to limit the front panel in the first direction, and the frame on the rear side of the front panel and the second limiting member of the foam door body engage each other to limit the front panel in the second direction, thereby achieving the limitation of the front panel in a plurality of different directions, and thereby significantly improving the strength of the refrigerator door with the replaceable door panel, and thereby adapting to the influence exerted by the transportation and the drop condition on the refrigerator door with the replaceable door panel. In addition, the first limiting member elastically pushes and resists against the insertion plate portion of the hook so that the mounting and detachment of the front panel is made more convenient.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator door with a replaceable door panel, wherein the refrigerator door comprises:

a foam door body, and a front panel detachably connected to the foam door body;

a first limiting member and a second limiting member are disposed on a front side of the foam door body;

a frame is sandwiched between the front panel and the foam door body, the frame is attached to a rear side of the front panel, a hook is disposed on the frame, and the hook has an insertion plate portion;

wherein when the front panel is assembled on the front side of the foam door body, the first limiting member, in cooperation with the insertion plate portion, limits a displacement of the front panel in a first direction; the second limiting member, in cooperation of the frame, limits a displacement of the front panel in a second direction;

wherein the first limiting member is a stopper which is disposed in a stopping groove of the foam door body, the insertion plate portion is inserted in the stopping groove, and the stopper elastically pushes and resists against the insertion plate portion in an up-down direction;

wherein the stopper comprises a body portion and an elastic portion, the elastic portion is disposed below the body portion, the elastic portion extends from an opening of the stopping groove towards rearward the stopping groove, and the elastic portion elastically pushes and resists against the insertion plate portion in the first direction.

2. The refrigerator door with a replaceable door panel according to claim 1, wherein the second limiting member is a magnetic member, and the magnetic member and the frame magnetically attract each other in a front-rear direction perpendicular to the front panel.

3. The refrigerator door with a replaceable door panel according to claim 2, wherein the magnetic member is a magnet, the frame is a metal frame, and the metal frame and the magnetic member magnetically attract each other in the front-rear direction perpendicular to the front panel.

4. The refrigerator door with a replaceable door panel according to claim 1, wherein a front end of the elastic portion is connected to a front end of the body portion, and a rear end of the elastic portion is suspended below the body portion and spaced apart a gap from the body portion.

5. The refrigerator door with a replaceable door panel according to claim 4, wherein the elastic portion extends obliquely downward along the front end of the body portion toward the rear end of the body portion.

6. The refrigerator door with a replaceable door panel according to claim 1, wherein a hook groove is disposed on the front side of the foam door body, a positioning block is disposed in the hook groove, the hook comprises a bent portion, a positioning notch is disposed on the bent portion, wherein when the front panel is assembled on the front side of the foam door body, the bent portion is inserted in the hook groove, and the positioning notch and the positioning block snap-fit each other.

7. The refrigerator door with a replaceable door panel according to claim 6, wherein the hook further comprises a connecting portion, both ends of the connecting portion are respectively connected with the bent portion and the frame, and the insertion plate portion is located on a lateral side of the connecting portion and protrudes in a direction away from the lateral side.

8. The refrigerator door with a replaceable door panel according to claim 1, wherein the refrigerator door further comprises a handle portion comprising a front handle and a rear handle, a stopping groove is provided on the front side of the foam door body, the front handle and the rear handle are respectively assembled in the stopping groove of the foam door body, and wherein a snap-fitting groove on the front handle and a boss of the rear handle snap-fit each other.

9. The refrigerator door with a replaceable door panel according to claim 8, wherein the boss comprises a cavity, and a top end of the boss is provided with a through hole; a cap body is disposed on a side of the snap-fitting groove away from the boss, and the cap body has another cavity, the through hole communicates the cavity of the boss with the another cavity of the cap body, wherein a bolt passes through the cavity and the through hole of the boss in turn and enter the another cavity of the cap body, thereby locking the boss and the cap body to each other.

10. The refrigerator door with the replaceable door panel according to claim 7, wherein a front side of the hook groove is an open structure which comprises a step portion, a shielding block is disposed on the step portion, a notch is formed between the shielding block and the open structure, and the bent portion and connecting portion of the hook enter through the notch into the hook groove.

* * * * *